US010932553B2

(12) United States Patent
Palmer

(10) Patent No.: US 10,932,553 B2
(45) Date of Patent: Mar. 2, 2021

(54) PRE-PACKAGED PAINT SAMPLE

(71) Applicant: Joe Palmer, Columbus, OH (US)

(72) Inventor: Joe Palmer, Columbus, OH (US)

( * ) Notice: Subject to any disclaimer, the term of this patent is extended or adjusted under 35 U.S.C. 154(b) by 0 days.

(21) Appl. No.: 16/529,277

(22) Filed: Aug. 1, 2019

(65) Prior Publication Data

US 2020/0037742 A1 Feb. 6, 2020

Related U.S. Application Data

(63) Continuation-in-part of application No. 16/052,066, filed on Aug. 1, 2018, now abandoned.

(51) Int. Cl.

| | |
|---|---|
| ***B05C 17/025*** | (2006.01) |
| ***A46B 11/00*** | (2006.01) |
| ***B65B 5/04*** | (2006.01) |
| ***B05C 17/02*** | (2006.01) |
| ***B65D 75/58*** | (2006.01) |
| ***B65D 81/20*** | (2006.01) |

(52) U.S. Cl.

CPC ..... *A46B 11/0003* (2013.01); *B05C 17/0215* (2013.01); *B65B 5/045* (2013.01); *B65D 75/5805* (2013.01); *B65D 81/2061* (2013.01); *A46B 2200/202* (2013.01)

(58) Field of Classification Search

USPC ..... 206/484; 15/104.93

See application file for complete search history.

(56) References Cited

U.S. PATENT DOCUMENTS

| | | | | |
|---|---|---|---|---|
| 6,007,264 | A * | 12/1999 | Koptis | B32B 3/02 401/132 |
| D484,325 | S | 12/2003 | Braswell | |
| 7,552,823 | B2 * | 6/2009 | Schuehrer | A45D 34/04 206/469 |
| 7,563,048 | B2 * | 7/2009 | Koptis | A45D 40/26 401/183 |
| 7,806,877 | B2 * | 10/2010 | Kang | A45D 40/0087 604/306 |
| 8,181,490 | B2 * | 5/2012 | Sinykin | D04B 1/02 66/191 |
| 9,139,038 | B1 | 9/2015 | Trollen | |
| 9,833,809 | B2 * | 12/2017 | Feddes | B65D 51/242 |
| 2005/0082197 | A1 * | 4/2005 | Carol | B65D 27/04 206/575 |
| 2005/0145518 | A1 | 7/2005 | Hong | |

(Continued)

FOREIGN PATENT DOCUMENTS

| | | | | |
|---|---|---|---|---|
| NL | 2009790 | C | 12/2014 | |
| WO | WO-2010136890 | A1 * | 12/2010 | B65D 75/52 |

*Primary Examiner* — Jennifer C Chiang

(74) *Attorney, Agent, or Firm* — Porter, Wright, Morris & Arthur, LLP

(57) ABSTRACT

A pre-packaged paint sample includes a sealed package, paint sealed within the package, and a new paint applicator sealed within the sealed package. For use, the package is shook to apply the paint to the paint applicator. The sealed package is opened, and the paint applicator is removed from the package. The paint applicator and used to apply the relatively small amount of the paint t. The pre-packaged paint sample can be useful in applications where only a small amount of paint is needed such as, for example but not limited to, paint sampling, paint touch up, and the like.

20 Claims, 10 Drawing Sheets

(56) References Cited

U.S. PATENT DOCUMENTS

| | | | | |
|---|---|---|---|---|
| 2005/0158474 | A1* | 7/2005 | Brandt ..... | B44D 3/003<br>427/401 |
| 2006/0280386 | A1 | 12/2006 | Bublitz | |
| 2007/0000800 | A1 | 1/2007 | Stoddart | |
| 2007/0031072 | A1 | 2/2007 | Gallardo, Jr. et al. | |
| 2007/0062823 | A1 | 3/2007 | Anderson | |

* cited by examiner

PRE-PACKAGED PAINT SAMPLE

CROSS-REFERENCE TO RELATED APPLICATIONS

This patent application is a continuation of U.S. patent application Ser. No. 16/052,066 filed on Aug. 1, 2018, the disclosure of which is expressly incorporated herein in it entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to paint containers and the like and, more particularly, to paint containers for relatively small quantities of paint such as for paint samples, touch-up, and the like.

BACKGROUND OF THE INVENTION

When trying to decide which color to paint walls, ceilings etc. in a home, homeowners often compare paint samples side by side to get a preview of the differences between the paint colors and how the wall, ceiling or other item will appear once painted. The types of paint samples typically available are paint chips, paint fans, and paint testers. Paint chips are loose squares or rectangles having the paint color. They are typically printed paper and do not have actual paint so there can be a wide variation from the actual paint color. Paint fans are pallets of bound paint swatches arranged in graduated form. The swatches are actually painted so there should not be any variation from the actual paint unless it is old and faded etc. However, it is still difficult to see what the actual wall would look like when painted in each color. Paint testers are small containers of paint that can be used to paint a portion of the actual wall to be painted. Thus, it provides a realistic view of what the wall will look like once fully painted.

While the paint testers may provide the most realistic view of what the wall will look like once fully painted, paint samples or testers are currently sold in cans or bottles in sizes typically ranging from 8 ounces to a quart. Therefore, most of the paint is discarded after using only a small fraction of the quantity of paint supplied. This is wasteful and not environmentally friendly.

Additionally, the paint testers are typically produced onsite at a retailer when requested by a consumer. Since each color of the paint must be custom mixed and packaged it can be very time consuming and thus the consumer may need to with a considerable period of time or return for pick-up at a later time. It also takes up the time of the retail clerk who must prepare each order on site.

Accordingly, there is a need in the art for improved paint samples and the like and/or methods for making and using the paint samples.

SUMMARY OF THE INVENTION

Disclosed are paint samples and methods for making and using the paint samples that overcome at least one of the disadvantages of the prior art described above. Disclosed is a pre-packaged paint sample comprising, in combination, a sealed package, paint sealed within the sealed-package, and a new paint applicator sealed within the sealed package with the paint.

Also disclosed is pre-packaged paint sample comprising, in combination, a sealed flexible stand-up pouch, paint sealed within the sealed flexible stand-up pouch, and a new paint applicator sealed within the sealed flexible stand-up pouch with the paint Further disclosed is a method for using a prepackaged paint sample comprising the steps of, in combination, obtaining pre-packaged paint sample comprising a sealed package, paint sealed within the sealed-package, and a new paint applicator sealed within the sealed package with the paint, shaking the package to at least partially load the new paint applicator with the paint, opening the package, removing the new paint applicator from the package, and using the new paint applicator to apply the paint.

From the foregoing disclosure and the following more detailed description of various preferred embodiments it will be apparent to those skilled in the art that the present invention provides a significant advance in the technology and art of paint samples and methods of making and using the paint samples. Particularly significant in this regard is the potential the invention affords for providing relatively small quantities of paint that not only reduce waste, but also can be shipped easily and inexpensively to retail establishments and directly to consumers. Additional features and advantages of various preferred embodiments will be better understood in view of the detailed description provided below.

BRIEF DESCRIPTION OF THE DRAWINGS

These and further features of the present invention will be apparent with reference to the following description and drawings.

Figure 1:
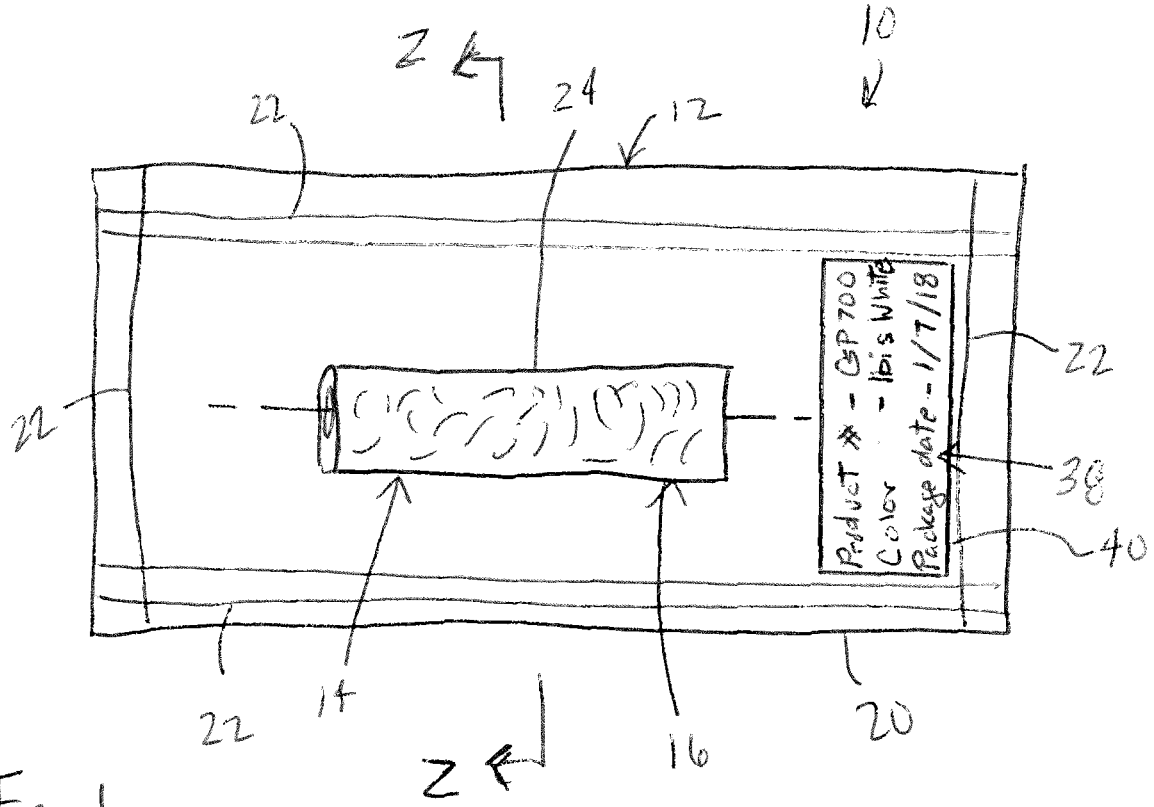
FIG. 1 is a view of a pre-packaged and pre-loaded paint applicator according to a first embodiment of the present invention.

It should be understood that the appended drawings are not necessarily to scale, presenting a somewhat simplified representation of various preferred features illustrative of the basic principles of the invention. The specific design features of the paint samples as disclosed herein, including, for example but not limited to, specific dimensions and shapes of the various components will be determined in part by the particular intended application and use environment. Certain features of the illustrated embodiments have been enlarged or distorted relative to others to facilitate visualization and clear understanding. In particular, thin features may be thickened, for example but not limited to, for clarity or illustration. All references to direction and position, unless otherwise indicated, refer to the orientation of the paint samples illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the paint samples disclosed herein. The following detailed discussion of various alternative and preferred embodiments will illustrate the general principles of the invention with regard to paint samples and the like. Other embodiments suitable for other applications will be apparent to those skilled in the art given the benefit of this disclosure.

Figure 2:
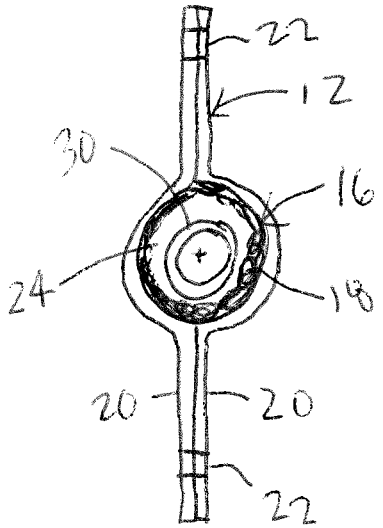
FIG. 2 is a sectional view of the pre-packaged and pre-loaded paint applicator of FIG. 1 taken along line 2-2 of FIG. 1.

FIGS. 1 and 2 illustrate a pre-packaged and pre-loaded paint applicator 10 according to a first embodiment of the present invention. The illustrated pre-packaged and pre-loaded paint applicator 10 includes a vacuum-sealed package 12 and a new paint applicator 14 sealed within the vacuum-sealed package 12 and having a paint receiving portion 16 pre-loaded with paint 18. The term "pre-packaged" is used herein and in the claims to means packaged before retail distribution or sale. The term "pre-loaded" is used herein and in the claims to mean loaded with paint by any means in advance of packaging and at a time removed from that of use. The term "new" is used herein and in the claims to mean not previously used for its intended purpose of applying paint to a surface other than when while being loaded with paint prior to being packaged.

The illustrated vacuum-sealed package 12 is a vacuum-sealed bag but any other suitable type of vacuum-sealed package can alternatively be utilized. The illustrated vacuum-sealed bag 12 is formed from two generally planar side walls or sheets 20 of plastic which are each rectangular shaped but any other suitable shape or configuration can alternatively be utilized. The two plastic sheets 20 are positioned generally back-to-back and sealed together about the perimeter to form a vacuum-sealed interior cavity between the two plastic sheets 20 for holding the pre-loaded new paint applicator 14. The illustrated plastic sheets 20 are sealed or secured together with four thermal or heat welds 22 with one of the four heat welds extending along each of the four edges of the rectangular-shaped plastic sheets 20. It is noted that the plastic sheets 20 can alternatively be sealed together in any other suitable manner and/or the thermal or heat welds 22 can alternatively have any other suitable configuration.

The illustrated plastic sheets 20 comprise a non-porous material having a low oxygen transmission rate (OTR) including but not limited to nylon, EVOH (ethylene vinyl alcohol), Biax-nylon-6, OPET (oriented polyester), and the like. A material is considered a "high oxygen barrier" if its oxygen transmission rate is less than 1 cc/100 $in^2$/24 hr. The plastic sheets 20 preferably have an OTR of about 3 cc/100 $in^2$/24 hr or less, more preferably have an OTR of about 2 cc/100 $in^2$/24 hr or less, and most preferably have an OTR of about 1 cc/100 $in^2$/24 hr. The plastic sheets 20 can have any suitable thickness and any suitable number of one or more layers. For example but not limited to, each plastic sheet 20 could have a single layer of nylon or can have multiple layers of nylon and poly-ethylene. The plastic sheets 20 can also be enhanced by coating or metalizing to enhance the OTR such as, for example but not limited to, metallized OPET, PVOH-coated OPP (AOH), metalized Biax Nylon-6, PVdC-coated OPET, high barrier PVdC-coated OPP, PvDC-coated Biax Nylon-6, metallized OPP, scalable PVdC-coated OPP, and the like. It is noted that the plastic sheets 20 can alternatively comprise any other suitable material and/or have any other suitable configuration.

Figure 3:
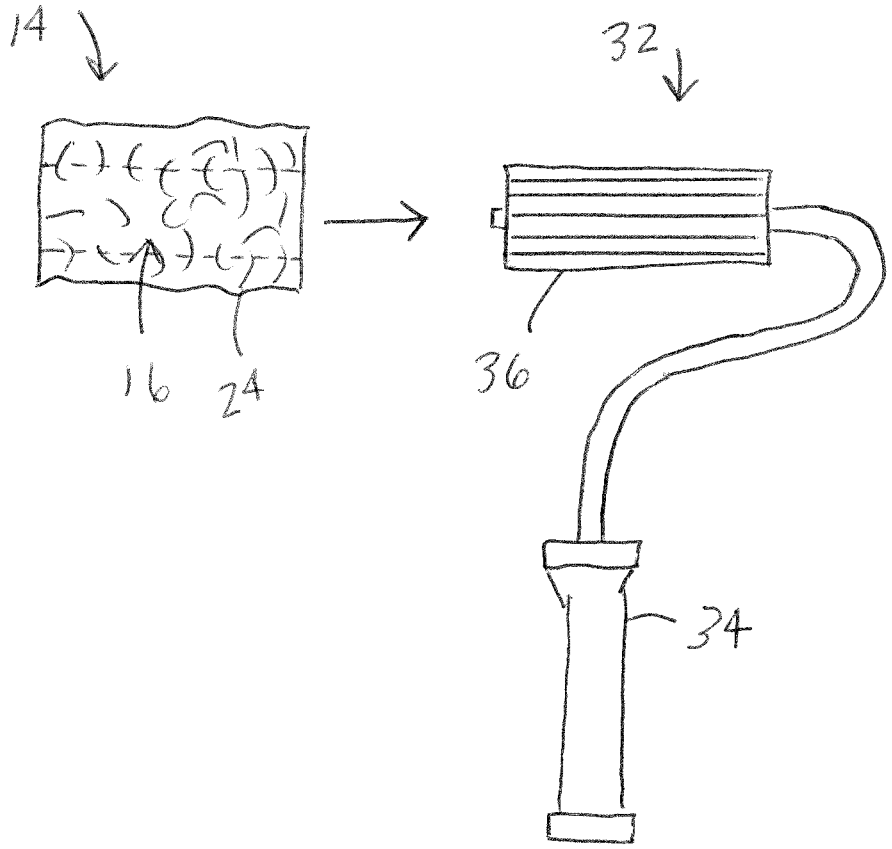
FIG. 3 is a view of the pre-loaded paint applicator of FIGS. 1 and 2 about to be secured to a handle.
Figure 4:
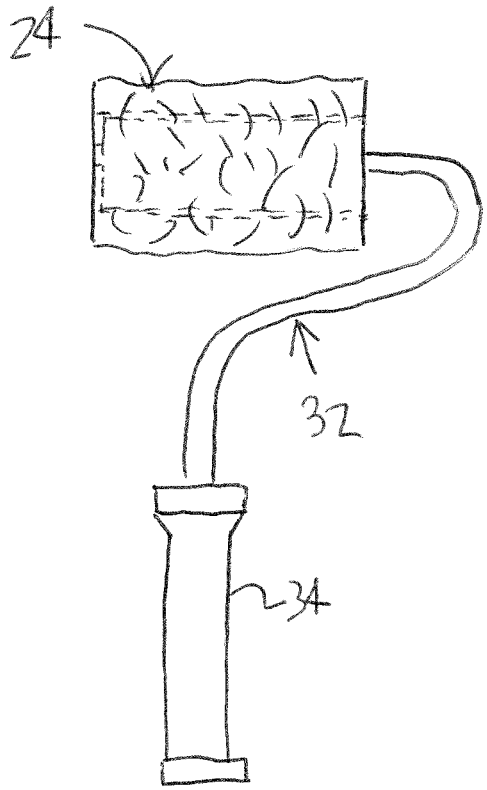
FIG. 4 is a view of the pre-loaded paint applicator of FIGS. 1 to 3 secured to the handle of FIG. 3 and ready to paint.

The illustrated new paint applicator 14 is in the form a roller cover 24 but any other suitable type of new paint applicator 14 can alternatively be utilized such as, for example but not limited to, a paint pad cover 26, a brush head 28, and the like. The illustrated roller cover 24 has an interior support tube 30 and the paint receiving portion 16 secured to an exterior surface of the support tube 30. The support tube 30 is sized and shaped to cooperate with a paint roller frame 32 having a handle 34 and a laterally extending roller 36 supported thereby. The roller 36 is rotatable relative to the handle 34. The roller cover 24 is selectively installed onto and removed from the roller 36 of the paint roller frame 32 and rotates as desired with the roller 36 during a painting operation (best seen in FIGS. 3 and 4). The support tube 30 can comprise any suitable material such as plastic, card board, paper board, and the like. The illustrated paint receiving portion 16 is secured to the exterior of the support tube 30 by an adhesive but any other suitable attachment means can alternatively be utilized. The width of the paint roller covers 24 is typically 2 to 18 inches. The illustrated paint roller cover 24 preferably has a width of about 2 to about 6 inches, and more preferably a width of about 4 inches but any other suitable width can alternatively be utilized. It is noted that the paint roller cover 24 can alternatively be any other suitable material, size and/or have any other suitable configuration.

The paint receiving portion 16 can be any suitable material that can absorb or soak up paint and then release a layer of the paint on surface to be painted when rolled along the surface to be painted. The rolling action creates a vacuum that pulls the paint off the roller cover 24. The paint receiving portion 16 of the paint roller cover 24 is typically a fiber such as, for example but not limited to, lamb's wool, mohair, synthetic fabric, and the like, or foam such as, for example but not limited to, Ethylene-vinyl acetate foam, urethane foam, and the like. Lamb's wool roller is best for oil-based paints and painting on any surface texture. Synthetic fabric is best for water-based paints and work for any surface textures. Foam is best with oil or high-gloss latex paints, and work best for smooth or textured surfaces. The thickness or length of the paint receiving portion's pile or nap can be any suitable thickness but is typically 1/16-inch to 1½-inch. It is noted that the paint receiving portion 16 of the paint roller cover 24 can alternatively be any other suitable material, size and/or have any other suitable configuration.

The illustrated new paint applicator 14 is pre-loaded with desired paint 18. That, is, the paint receiving portion 16 of the new paint applicator 14 has absorbed the desired amount, type and color of the paint 18 and is ready for painting prior to being sealed into the vacuum-sealed package 12. The paint 18 can be of any suitable type such as, for example but not limited to, an oil-based paint, a water-based paint, a stain, and the like. The paint 18 can also be of any suitable color. The paint receiving portion 16 of the new paint applicator 14 is preferably pre-loaded with about 3 ounces or less of the paint 18, is more preferably, pre-loaded with about 2 ounces or less of the paint 18, and most preferably pre-loaded with about 1 ounce or less of the paint 18. The small quantity of paint 18 reduces waist when used as sample paint, touch-up paint, or the like.

The illustrated vacuum-sealed package 12 also includes content information 38 content information provided thereon. The Illustrated content information 38 is printed or marked onto a label 40 secured to an outside surface of the package with adhesive or the like but it is noted that the content information 38 can alternatively be directly printed or marked on the outside surface of the vacuum-sealed package 12. The illustrated content information 38 can include (1) paint brand; (2) paint product number; (3) paint name; (4) paint type (such as exterior or interior); (5) packaging date, and/or (6) expiration date or use by date. It is noted that the content information 38 can alternatively include any one or more of these items of information and/or can additionally include any other suitable item(s) of information relating the vacuum-sealed package 12 or its contents.

A method of making the pre-packaged and pre-loaded paint applicator assembly 10 includes the steps of obtaining the new paint applicator 14 such as the paint roller cover 24, and obtaining a suitable quantity of the paint 18 desired to be supplied for sampling or touch-up etc. The paint receiving portion 16 of the new paint applicator 14 is then loading with the paint 18. The new paint applicator 14 can be loaded with the paint 18 by soaking, dipping, rolling, spraying, rubbing, wiping, and/or the like. The pre-loaded new paint applicator 14 is then placed entirely within the package 12 such as the illustrated plastic bag through an opening. The pre-loaded new paint applicator 14 is then vacuum sealed within the package 12. The open end of the package 12 is placed within a vacuum chamber where a vacuum generating device removes air from the package 12. With the air removed, the flexible walls of the bag 12 collapse to closely conform to the shape of the pre-loaded new paint applicator 14. Once the air is removed from the package 12, a sealing device seals the open end of the package with the final thermal or heat weld 22. The pre-packaged and pre-loaded paint applicator assembly 10 can then be distributed or sold directly to consumers or to retailers for distribution or sale to consumers. The consumers can tear open the vacuum-sealed package 12, remove, the pre-loaded new paint applicator 14 from the package 12, attach the pre-loaded new paint applicator 14 to the handle 34, and use the relatively small quantity of paint 18 pre-loaded onto the paint receiving portion 16 of the new paint applicator 14 as a paint sample or as touch-up paint etc. The one-time use package 12 can be discarded. The above illustrated method enables relatively small quantity paint samples to be prepared and stored in advance of sale or distribution to consumers and/or off site of the location of sale or distribution to consumers.

Figure 5:
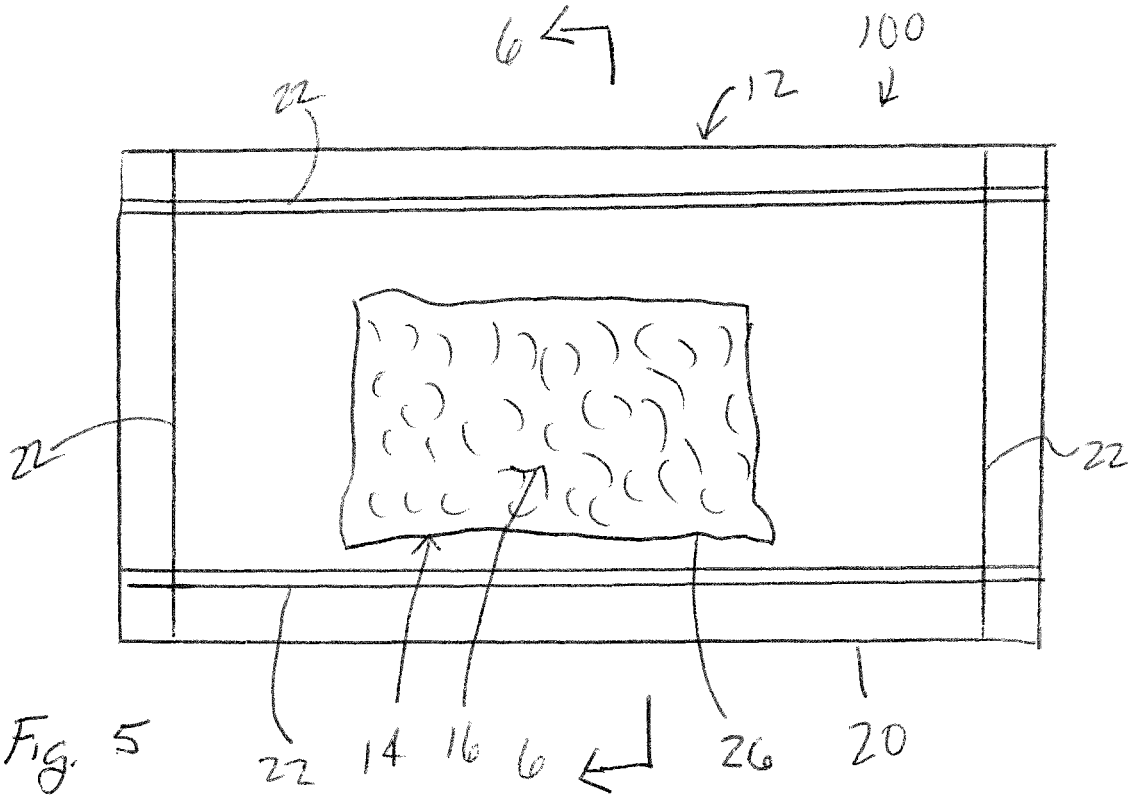
FIG. 5 is a view of a pre-packaged and pre-loaded paint applicator according to a second embodiment of the present invention.
Figure 6:
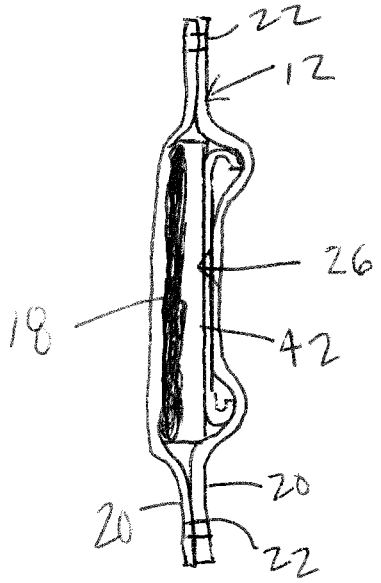
FIG. 6 is a sectional view of the pre-packaged and pre-loaded paint applicator of FIG. 5 taken along line 6-6 of FIG. 5.

FIGS. 5 and 6 illustrate a pre-packaged and pre-loaded paint applicator assembly 100 according to a second embodiment of the present invention. The second embodiment is substantially the same as the first embodiment except that the new paint applicator 14 of the second embodiment is a paint pad cover 76 instead of the paint roller cover 24 of the first embodiment.

Figure 7:
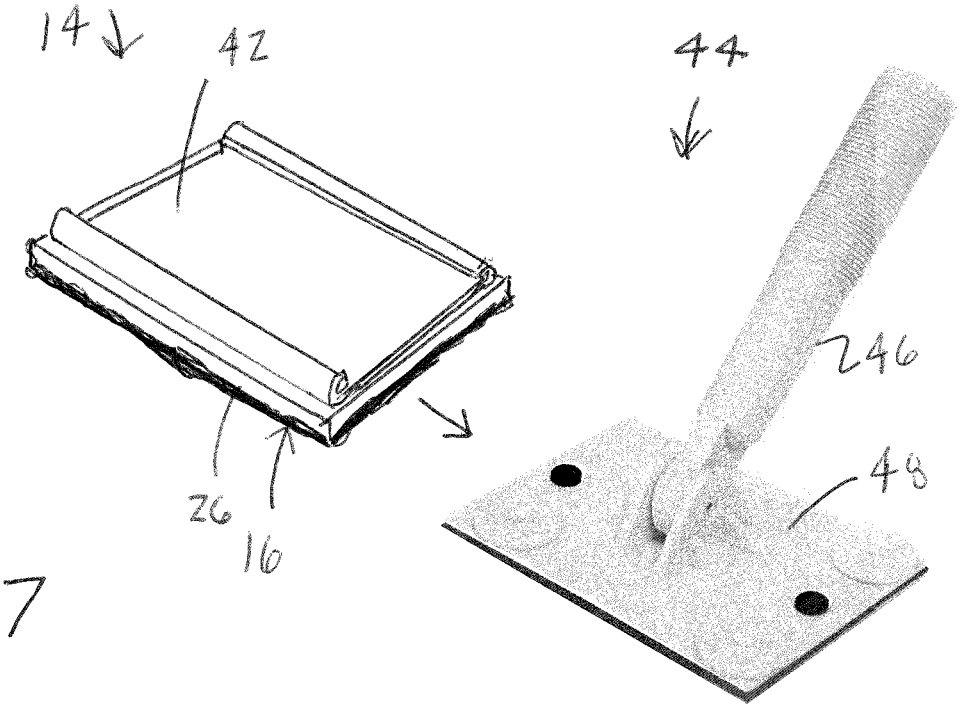
FIG. 7 is a view of the pre-loaded paint applicator of FIGS. 5 and 6 about to be secured to a handle.
Figure 8:
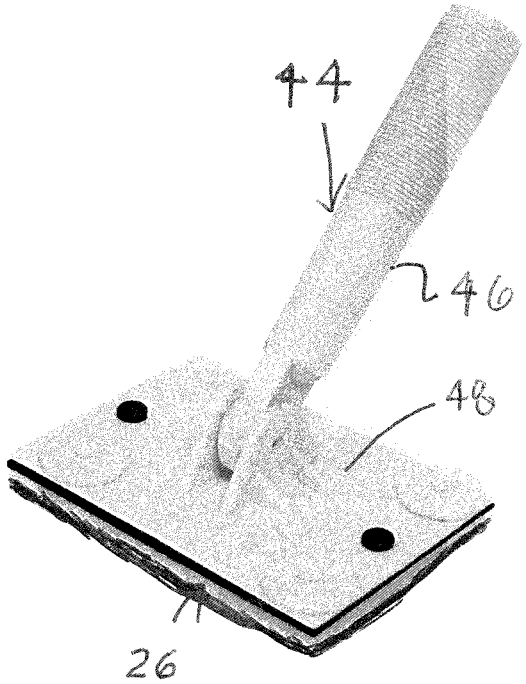
FIG. 8 is a view of the pre-loaded paint applicator of FIGS. 5 to 7 secured to the handle of FIG. 7 and ready to paint.

The illustrated new paint applicator 14 of the second embodiment is in the form a paint pad cover 76. The illustrated paint pad cover 76 has a rigid backing plate 42 covered with the paint receiving portion 16 on one side. The backing plate 42 is sized and shaped to cooperate with a paint pad frame 44 having a handle 46 and an attachment portion or pad 48 supported thereby. The backing plate 42 can be selectively installed onto and removed from the attachment portion or pad 48 of the paint pad frame 44 so that the paint pad cover 26 moves with the paint pad frame 44 during a painting operation (best seen in FIGS. 7 and 8). The backing plate can comprise any suitable material such as plastic, metal, and the like. The illustrated paint receiving portion 16 is secured to the front side of the backing plate 42 by an adhesive but any other suitable attachment means can alternatively be utilized. The width of the paint pad cover 26 is typically 2 to 9 inches. The illustrated paint pad cover 26 preferably has a width of about 3 to about 5 inches, and more preferably a width of about 4 inches but any other suitable width can alternatively be utilized. It is noted that the paint pad cover 26 can alternatively be any other suitable material, size and/or have any other suitable configuration.

The paint receiving portion 16 can be any suitable material that can absorb or soak up paint and then release a layer of the paint on surface to be painted when rubbed or wiped across the surface to be painted. The wiping action rubs the paint off the paint pad cover 26 onto the surface to be painted. The illustrated paint receiving portion 16 is a pad of plastic foam faced with nylon fiber pile. However, the paint receiving portion 16 can alternatively comprise brush bristles, open cell foam, woven fabric, and/or various other fluid absorbing or wicking material suitable for painting. It is noted that the paint receiving portion 16 of the paint pad cover 26 can alternatively be any other suitable material, size and/or have any other suitable configuration.

Figure 9:
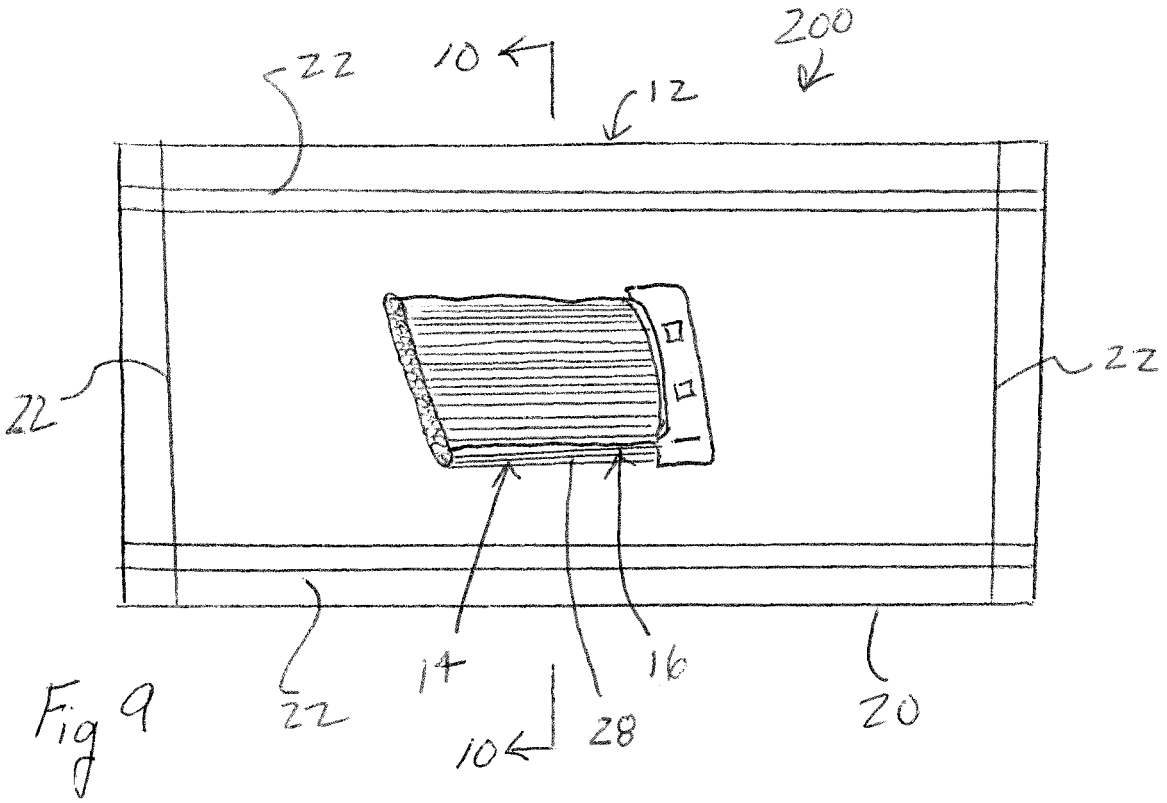
FIG. 9 is a view of a pre-packaged and preloaded paint applicator according to a third embodiment of the present invention.
Figure 10:
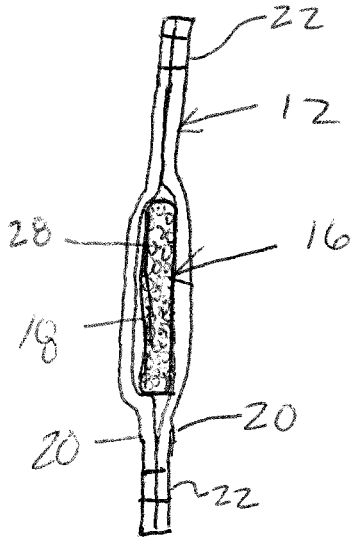
FIG. 10 is a sectional view of the pre-packaged and pre-loaded paint applicator of FIG. 9 taken along line 10-10 of FIG. 9.

FIGS. 9 and 10 illustrate a pre-packaged and pre-loaded paint applicator assembly 200 according to a third embodiment of the present invention. The third embodiment is substantially the same as the first embodiment except that the new paint applicator 14 of the third embodiment is a paint brush head 28 for a paint brush frame 50 instead of the paint roller cover 24 for a paint roller frame 32 of the first embodiment.

Figure 11:
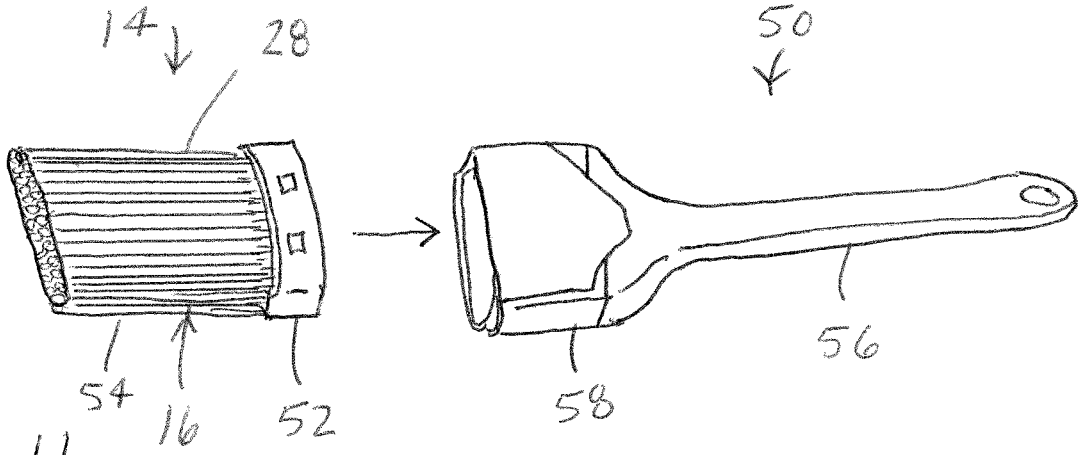
FIG. 11 is a view of the pre-loaded paint applicator of FIGS. 9 and 10 about to be secured to a handle.
Figure 12:
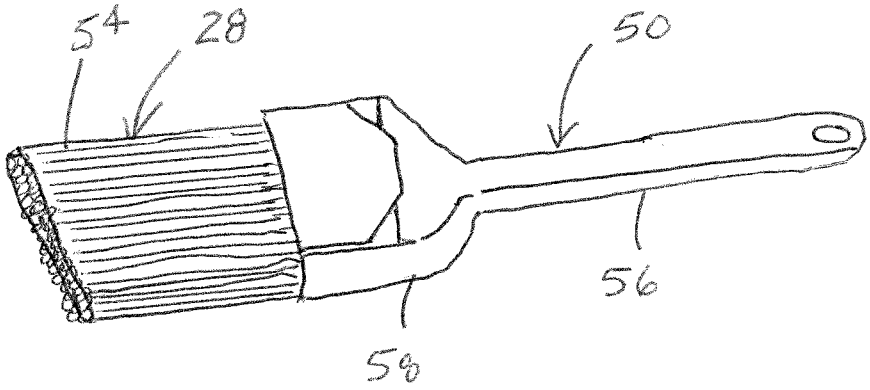
FIG. 12 is a view of the pre-loaded paint applicator of FIGS. 9 to 11 secured to the handle of FIG. 11 and ready to paint.

The illustrated new paint applicator 14 of the third embodiment is in the form a paint brush head 28. The illustrated paint brush head 28 has a rigid bristle holder 52 with the paint receiving portion 16 in the form of a plurality of bristles 54 extending from one side. The bristle holder 52 is sized and shaped to cooperate with a paint brush frame 50 having a handle 56 and an attachment portion 56 supported thereby. The bristle holder 52 is selectively installed onto and removed from the attachment portion 58 of the paint brush frame 50 and moves with the paint brush frame 50 as desired during a painting operation (best seen in FIGS. 11 and 12). The bristle holder 52 can comprise any suitable material such as plastic, metal, and the like. The illustrated paint receiving portion 16 is secured to the front side of the bristle holder 52 by an adhesive but any other suitable attachment means can alternatively be utilized. The width of the paint brush head 28 is typically 1 to 6 inches. The illustrated paint brush head 28 preferably has a width of about 3 to about 4 inches, and more preferably a width of about 3.5 inches but any other suitable width can alternatively be utilized. It is noted that the paint brush head 28 can alternatively be any other suitable material, size and/or have any other suitable configuration.

The paint receiving portion 16 can be any suitable plurality of bristles 54 that can absorb or soak up paint and then release a layer of the paint 18 on surface to be painted when rubbed or wiped across the surface to be painted. The wiping action rubs the paint off the bristles 54 onto the surface to be painted. The bristles 54 can be any suitable natural or synthetic material. Natural bristles are typically made from some sort of animal hair, such as hog or badger. Synthetic bristles are typically made from nylon, polyester, or a combination of both. Natural-bristles are best for applying oil-based alkyd paints, and synthetic-bristles are best for applying water-based latex paints. It is noted that the paint receiving portion 16 of the paint brush head 28 can alternatively be any other suitable material, size, and/or have any other suitable configuration.

Figure 13:
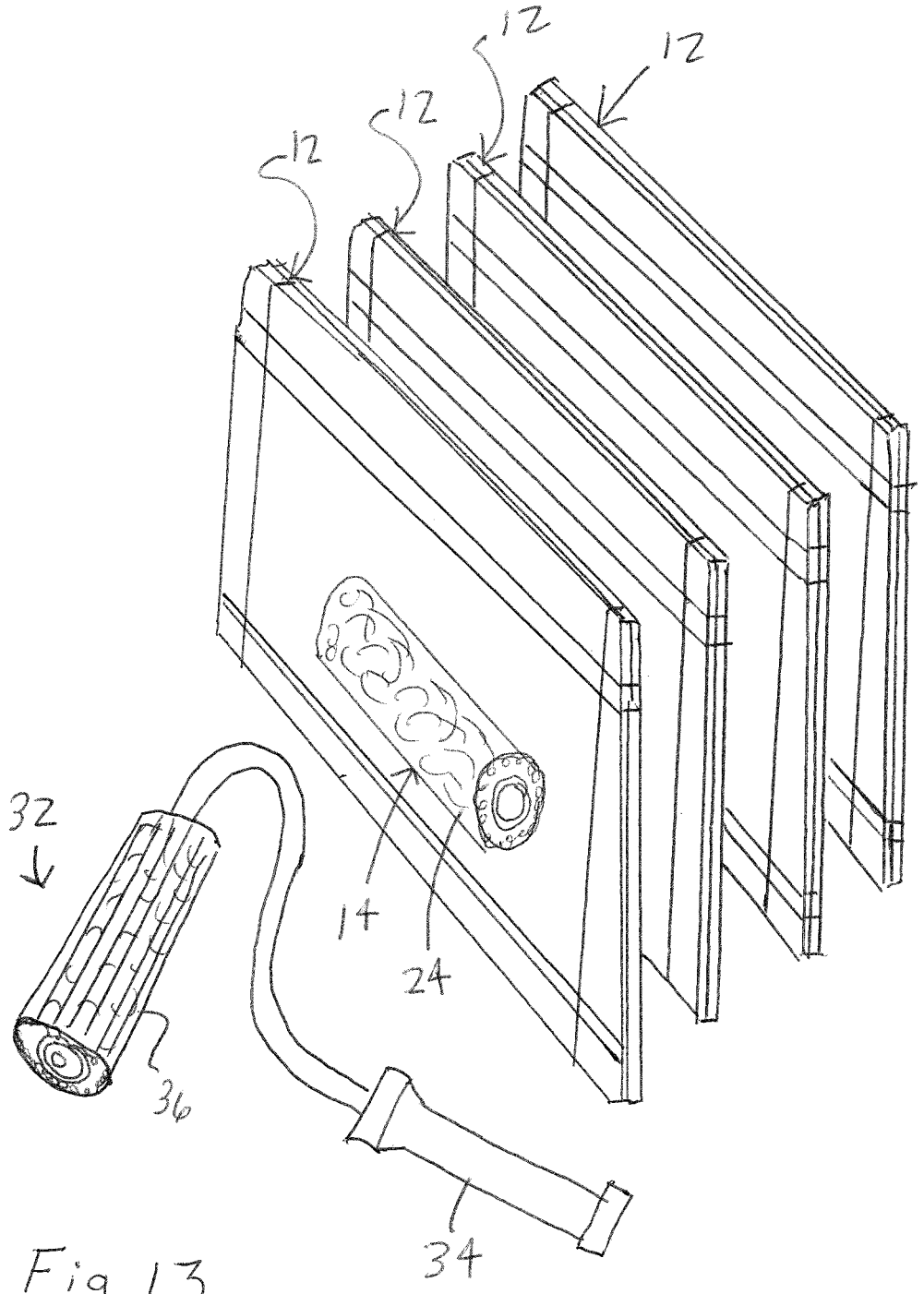
FIG. 13 is a view of a kit comprising a plurality of the pre-packaged and pre-loaded paint applicators and a single handle for use with the paint applicators.
Figure 14:
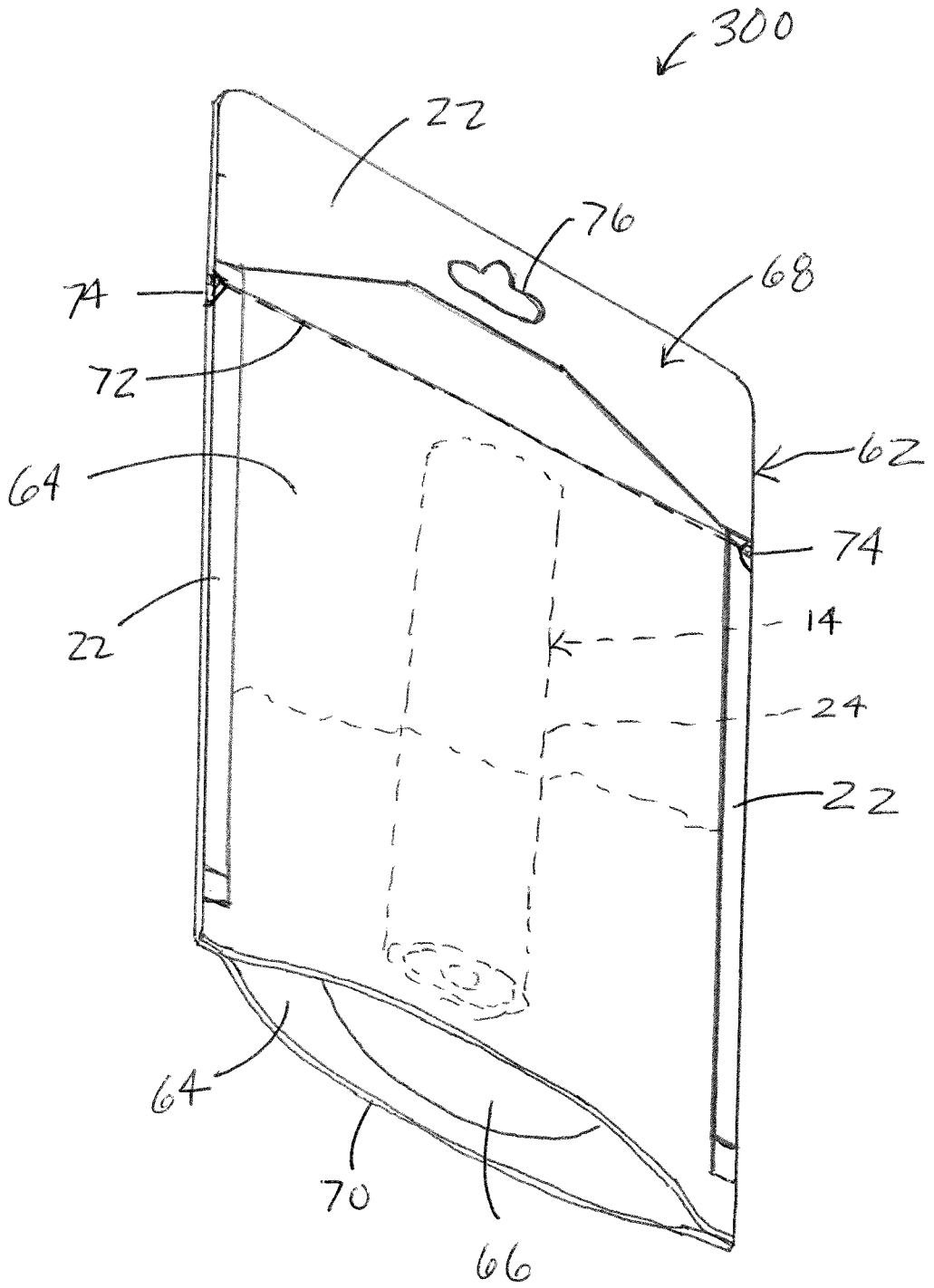
FIG. 14 is a perspective view of a pre-packaged paint sample according to a fourth embodiment of the present invention.
Figure 15:
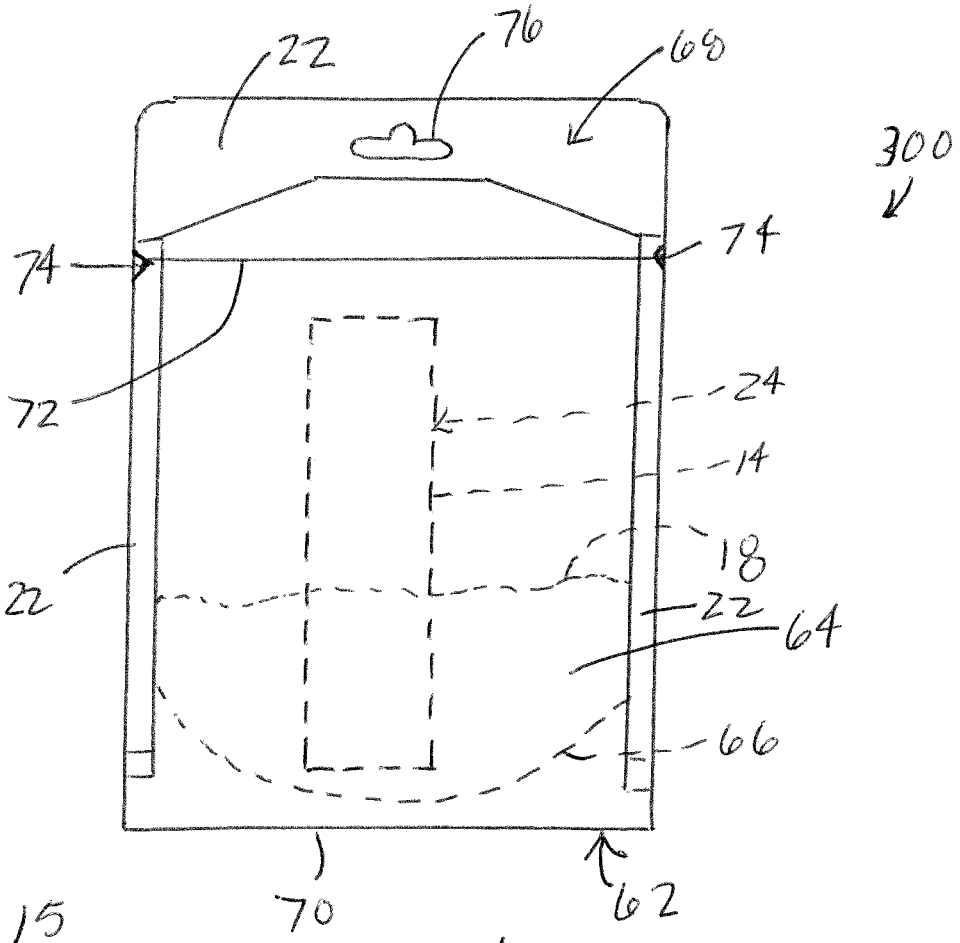
FIG. 15 is a front view of the pre-packaged paint sample of FIG. 14, wherein the rear view of the pre-packaged paint sample is the same.
Figure 16:
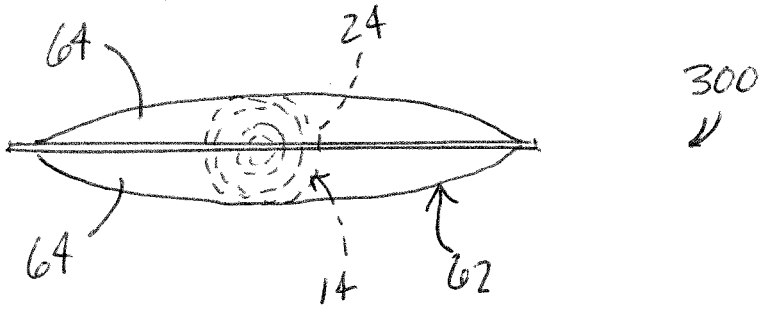
FIG. 16 is a top view of the pre-packaged paint sample of FIGS. 14 and 15.
Figure 17:
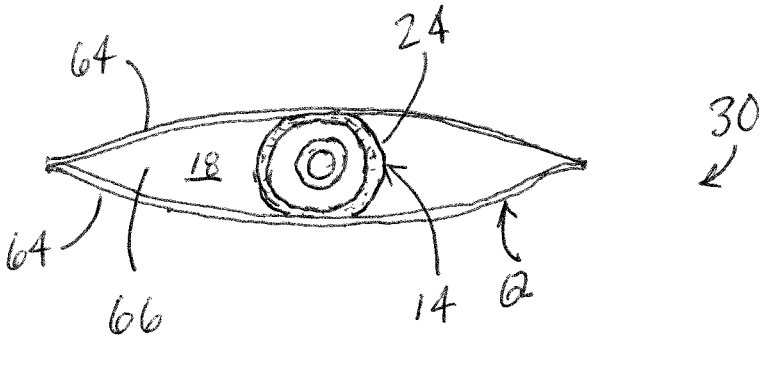
FIG. 17 is a bottom view of the pre-packaged paint sample of FIGS. 14 to 16.

As shown in FIG. 13, the pre-packaged and pre-loaded paint applicators assemblies 10 can form a kit 60 comprising any quantity of the vacuum-sealed packages 12 with the vacuum-sealed packages each including one or more different colors of paint 18 to be sampled or used for touch up. When the paint 18 is to be used as sample paint, the vacuum-sealed packages 12 typically include different colors of paint 18. When the paint 18 is to be used as touch-up paint, the vacuum-sealed packages 12 typically include the same color of paint 18. The kit 60 can also include a handle 34, 46, 56 suitable for use with the enclosed new paint applicators 14 such as a paint roller frame 32 when vacuum-sealed packages 12 include the pre-loaded paint roller covers 24, the paint pad frame 44 when the vacuum-sealed packages 12 include the pre-loaded paint pad covers 26, and the paint brush frame 50 when the packages include pre-loaded paint brush heads 28.

FIGS. 14 to 19 illustrate a pre-packaged a paint sample 300 according to a fourth embodiment of the present invention. The illustrated pre-packaged paint sample 300 includes a sealed package 62, liquid paint 18 sealed within the sealed-package 62, and a new paint applicator 14 sealed within the sealed package 62 with the liquid paint 18.

The illustrated sealed package 62 is a flexible bag and, more specifically, a flexible stand-up pouch but any other suitable type of package can alternatively be utilized. The illustrated flexible stand-up pouch 62 includes two generally planar front and back side walls or sheets 64 and a bottom wall or gusset 66. The illustrated front and back side walls 64 are each rectangular shaped but any other suitable shape or configuration can alternatively be utilized. The front and back side walls 64 are positioned generally back-to-back and sealed together along their opposed side edges and along the top edges. The illustrated front and back walls 64 are sealed or secured together with thermal or heat welds 22. Two of the heat welds 22 extend along the opposed lateral side edges of the front and back side sheets 64. Another heat weld 22 extends along the top edge of the front and back side walls 64 to form a header 68. It is noted that the front and back side walls 64 can alternatively be sealed together in any other suitable manner and/or the thermal or heat welds 22 can alternatively have any other suitable configuration.

The bottom wall or gusset 66 is sealed to the front and back side walls 64 near the bottom edges of the front and back side walls 64 to form a sealed interior cavity or compartment for holding the liquid paint 18 and the new paint applicator 14. With the gusset 66 spaced above the bottom edges of the front and back side walls 64, lower edges of the flexible stand-up pouch 62 form a bottom rim 70 and the bottom gusset 66 is upwardly recessed from and contained within a perimeter of the bottom rim 70. The illustrated bottom wall or gusset 66 is substantially elliptical shaped but any other suitable configuration can be alternatively utilized. Configured in the manner the flexible stand-up pouch 62, can lay flat in an empty configuration and can expand outwardly in the front and back direction in a use configuration. Note that in the use configuration (best seen in FIG. 14), the flexible stand-up pouch 62 can rest in an upright or standing position with the bottom rim 70 engaging a horizontal support surface such as, for example but not limited to, a table top, a floor, the ground, and the like.

The illustrated front and side walls 64 are also each provided with a weakened portion or tear strip or line 72 located below and near the header 68 that extends between the side edges of the front and back side walls 62. The weakened portions 72 can be of any suitable type such as, for example but not limited to, a score, perforations, and the like at a desired depth to provide a precise tear path. One or both ends of the weakened portions 72 can be provided with a V-shaped notch 74 cut into one or both sends of the weakened portions 72 that provide stress concentration and aid in starting a tear along the tear line 72. The weakened portions 72 of the flexible stand-up pouch 62 are selectively torn by the user in a lateral direction to open the flexible stand-up pouch 62 in order to gain access to the interior cavity and the contents therein. The weakened portions 74 can alternatively have any other suitable configuration such as, for example but not limited to, having only a single edge notch 74. Once torn open, the illustrated flexible stand-up pouch 62 is not resealable or reclosable. The flexible stand-up pouch 62 is preferably non-resealable or reclosable due to cost and paint quantity. However, a resealable fastener can be provided if desired such as, for example but not limited to, a reclosable zipper seal between the front and back side walls 64 below the tear line 72.

The illustrated header 68 is provided with a hanger opening 76 for use with a hanging retail display. The illustrated opening 76 is of the "batwing" type but any other suitable shape can alternatively be utilized. The illustrated hanger opening 76 is centrally positioned between the lateral side edges but any other suitable location can alternatively be utilized. The hanger opening 76 can be formed in any suitable manner such as, for example but not limited to, punching and the like. The hanger opening 76 can be eliminated if desired.

The walls or sheets 64, 66 can comprise a wide variety of materials that meet certain preferred specifications. For example but not limited to, the walls 64, 66 are preferably thin to reduce the amount of material used and the associated cost while being sufficiently thick and tough enough to resist punctures and leaks caused by abrasion and tough handling. The walls 64, 66 are also preferably selected from materials that can be easily handled, formed, and sealed together, preferably by heat-sealing, in a high-speed manufacturing setting by using a high-speed form, fill, and seal apparatus. Furthermore, the walls 64, 66 are preferably made of a single layer of material or a laminate combination of layers of materials that provides an adequate barrier against moisture, oxygen, and light which may adversely affect the performance or quality of the product contained within the pouch. The layer or layers of the walls 64, 66 can comprise plastic, metallized plastic, metal foil, and the like.

Figure 20:
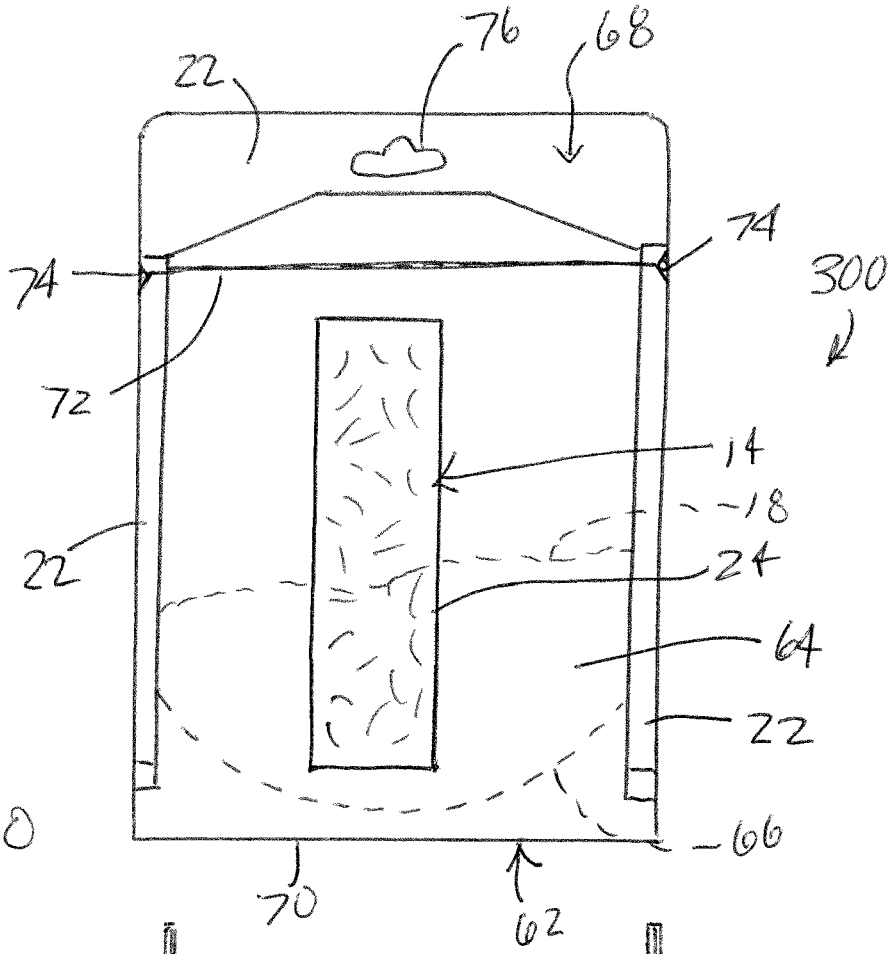
FIG. 20 is a variation of the front view of the pre-packaged paint sample of FIG. 15, wherein the front wall is transparent.
Figure 18:
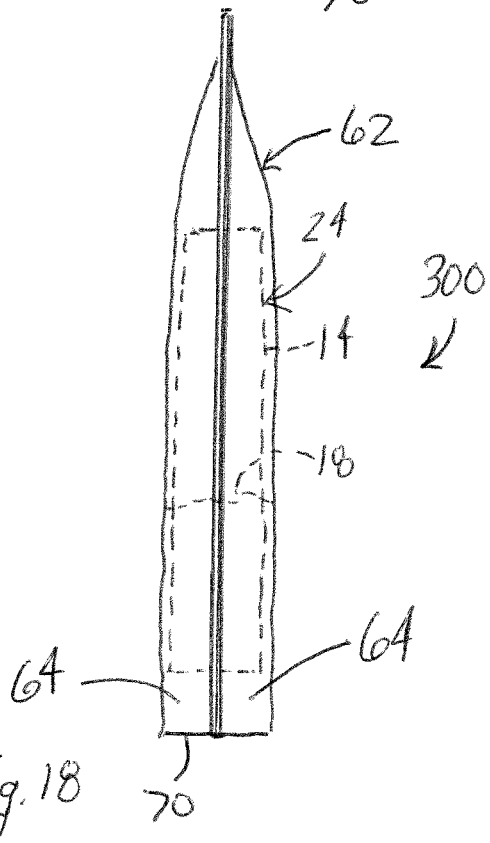
FIG. 18 is a left-side view of the pre-packaged paint sample of FIGS. 14 to 17.
Figure 19:
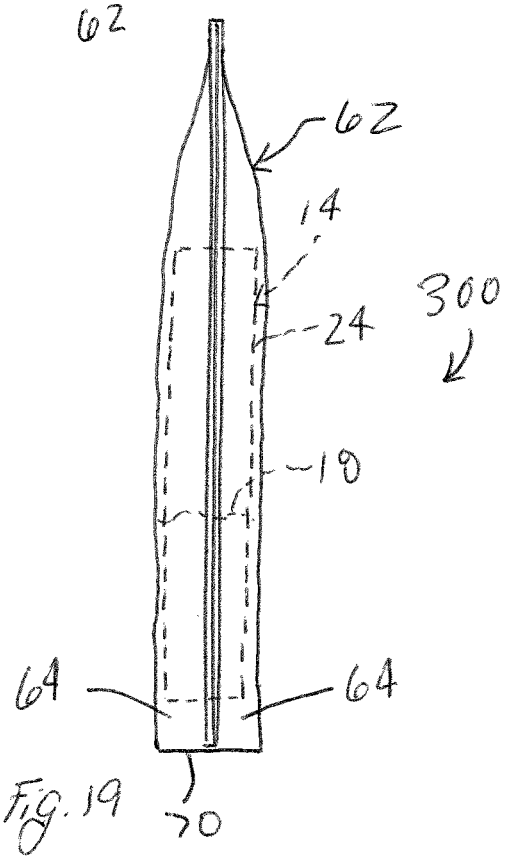
FIG. 19 is a right-side view of the pre-packaged paint sample of FIGS. 14 to 18.

The front and back side walls 64 of the illustrated flexible stand-up pouch 62 are opaque while the gusset 66 of the illustrated flexible stand-up pouch 62 is transparent. This configuration enables suitable indicia, such as that discussed hereinabove, to be provided on one or both of the front and back side walls while the gusset enables the consumer to easily see the color of the paint inside (at least in its liquid form). Other combinations of opaque and/or transparent walls 64, 66 can alternatively be utilized. For example but not limited to, FIG. 20 illustrates a flexible stand-up pouch 62 wherein the front side wall 64 is transparent.

As discussed hereinabove, the liquid paint 18 can be of any suitable type such as, for example but not limited to, an oil-based paint, a water-based paint, a stain, and the like. The liquid paint 18 can also be of any suitable color. The cavity or compartment of the flexible stand-up pouch 62 is preferably filled with about 3 to 5 ounces or less of the liquid paint 18, is more preferably, filled with about 2 ounces or less of the liquid paint 18, and most preferably filled with about 1 ounce or less of the liquid paint 18.

As discussed hereinabove, the illustrated new paint applicator 14 is in the form a roller cover 24 but any other suitable type of new paint applicator 14 can alternatively be utilized such as, for example but not limited to, a paint pad cover 26, a brush head 28, and the like. The roller cover is placed in the cavity or compartment of the flexible stand-up pouch 62. The illustrated roller cover 24 is unloaded with the liquid paint 18 prior to insertion into the cavity or compartment of the flexible stand-up pouch 62, but alternatively can be partially or fully loaded with the liquid paint 18 prior to insertion into the cavity or compartment of the flexible stand-up pouch 62.

An exemplary method for using the pre-packaged paint sample 300 is as follows.

First, a pre-packaged paint sample 300, as described hereinabove, is obtained by the user. When the user is ready to apply the liquid paint 18, the user shakes the flexible stand-up pouch 62 to at least partially load or cover the new paint applicator 14, which in the illustrated case is a roller cover 24, with the liquid paint 18 which are each located together in the sealed cavity of the flexible stand-up pouch 62. If needed, the user can rub the flexible side walls 64 of the flexible stand-up pouch 62 in order to evenly distribute the liquid paint 18 over the roller cover 24. Once the roller cover 24 is covered with the liquid paint 18 as desired, the user opens the flexible stand-up pouch 62 by tearing the side walls 64 along the weakened area or "tear line" 72. With the flexible stand-up pouch 62 torn open, the user can remove the roller cover 24 and place it on a roller 36. The user can then apply the liquid paint 18 to a desired surface such as, for example but not limited to, a wall and the like. The user then allows the paint 18 to dry so that, for example but not limited to, the user can observe a sample area of the dry paint, the user can repair a damaged or marked up area of prior applied paint of the same type and color, and the like.

Any of the features or attributes of the above-described embodiments and variations can be used in combination with any of the other features and attributes of the above-described embodiments and variations as desired.

From the foregoing disclosure and detailed description of certain exemplary embodiments, it will be apparent that the illustrated pre-packaged paint samples provide an efficient and inexpensive way to distribute a small quantity of paint such as, for example but not limited to, paint color samples, touch-up paint, and the like. It will also be apparent that the illustrated pre-packaged paint samples provide an efficient and inexpensive method to produce paint color samples, touch-up paint, and the like in advance and/or off-site so that retail employees are not required to prepare cans of color sample of touch-up paint on-site and on-demand. Additionally, the above-described packages and methods are more environmentally friendly than prior art because there is less wasted paint that must be disposed.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A pre-packaged paint sample comprising, in combination:

a sealed package having an internal cavity;

wherein the sealed package is a flexible bag comprising at least one of plastic, metallized plastic, and metal foil;

paint sealed within the internal cavity of sealed-package;

a new paint applicator sealed within the internal cavity of the sealed package with the paint;

wherein the new paint applicator is a paint roller cover; and wherein the flexible bag is configured to evenly distribute the paint onto the paint roller cover when the flexible bag is rubbed against the paint roller cover within the internal cavity of the sealed package with the paint.

2. The pre-packaged paint sample according to claim 1, wherein the flexible bag is a stand-up pouch.

3. The pre-packaged paint sample according to claim 1, wherein the flexible bag is a non-resealable flexible bag.

4. The pre-packaged paint sample according to claim 1, wherein the package is provided with content information including at least one of a paint product number, a paint color name, a packaging date, or an expiration date.

5. The pre-packaged paint sample according to claim 1, wherein the sealed flexible package is at least partially transparent so that the paint within the internal cavity can be viewed from outside the sealed package.

6. The pre-packaged paint sample according to claim 1, wherein the paint roller cover is unloaded or only partially loaded with the paint prior to insertion into the internal cavity of the sealed package.

7. The pre-packaged paint sample according to claim 1, wherein the sealed package is vacuum sealed.

8. A pre-packaged paint sample comprising, in combination:

a sealed flexible stand-up pouch;

paint sealed within the sealed flexible stand-up pouch; and a new paint applicator sealed within the sealed flexible stand-up pouch with the paint.

9. The pre-packaged paint sample according to claim 8, wherein the sealed flexible stand-up pouch comprises at least one of plastic, metallized plastic, and metal foil.

10. The pre-packaged paint sample according to claim 8, wherein the sealed flexible stand-up pouch is a non-resealable sealed flexible stand-up pouch.

11. The pre-packaged paint sample according to claim 8, wherein the paint applicator is a paint roller cover.

12. The pre-packaged paint sample according to claim 8, wherein the package is provided with content information including at least one of a paint product number, a paint color name, a packaging date, or an expiration date.

13. The pre-packaged paint sample according to claim 8, wherein at least one side wall of the sealed flexible stand-up pouch is at least partially transparent.

14. The pre-packaged paint sample according to claim 8, wherein a bottom wall of the sealed flexible stand-up pouch is at least partially transparent.

15. A method for using a prepackaged paint sample comprising the steps of, in combination:

obtaining pre-packaged paint sample comprising a sealed package, paint sealed within the sealed-package, and a new paint applicator sealed within the sealed package with the paint;

shaking the package to at least partially load the new paint applicator with the paint;

opening the package;

removing the new paint applicator from the package; and using the paint applicator to apply the paint.

16. The method according to claim 15, wherein the package is a flexible bag comprising at least one of plastic, metallized plastic, and metal foil.

17. The method according to claim 16, wherein the flexible bag is a stand-up pouch.

18. The method according to claim 16, wherein the flexible bag is a non-resealable flexible bag.

19. The method according to claim 15, wherein the package is non-resealable package.

20. The method according to claim 15, wherein the paint applicator is a paint roller cover.

* * * * *